United States Patent [19]

Engelhardt et al.

[11] Patent Number: 4,693,430

[45] Date of Patent: Sep. 15, 1987

[54] WINDING STATION OF AN AUTOMATIC WINDING MACHINE

[75] Inventors: Dietmar Engelhardt; Hans Grecksch, both of Monchen-Gladbach, Fed. Rep. of Germany

[73] Assignee: W. Schlafhorst & Co., Monchen-Gladbach, Fed. Rep. of Germany

[21] Appl. No.: 912,765

[22] Filed: Sep. 26, 1986

[30] Foreign Application Priority Data

Sep. 26, 1985 [DE] Fed. Rep. of Germany ..... 3534267

[51] Int. Cl.[4] ..... B65H 49/04; B65H 67/02

[52] U.S. Cl. ..... 242/18 R; 242/35.5 R; 242/35.6 R

[58] Field of Search ..... 242/18 R, 35.5 R, 35.5 A, 242/35.6 R, 129.5, 130

[56] References Cited

U.S. PATENT DOCUMENTS

| | | | |
|---|---|---|---|
| 1,889,815 | 12/1932 | Taylor | 242/35.5 R X |
| 1,978,550 | 10/1934 | Reiners et al. | 242/35.5 R |
| 2,124,499 | 7/1938 | Swanson | 242/35.5 R |
| 2,407,366 | 9/1946 | Cotchett et al. | 242/35.6 R |
| 2,733,870 | 2/1956 | Furst | 242/35.6 R |
| 3,121,540 | 2/1964 | Furst | 242/35.5 R |
| 3,155,332 | 11/1964 | Townsend | 242/35.5 R |
| 3,172,610 | 3/1965 | Furst | 242/35.5 R |
| 3,182,922 | 5/1965 | Mullers | 242/35.5 R |
| 3,281,088 | 10/1966 | Matsui et al. | 242/35.6 R |
| 3,329,362 | 7/1967 | Kieronski | 242/35.6 R |
| 3,399,840 | 9/1968 | Hayashi et al. | 242/35.5 R |

*Primary Examiner*—Stanley N. Gilreath

*Attorney, Agent, or Firm*—Herbert L. Lerner; Laurence A. Greenberg

[57] ABSTRACT

A winding station of an automatic winding machine, includes a holder, a movable mounting mandrel supported by the holder for receiving a tube of a feeding bobbin, a bobbin delivery slide for feeding a bobbin to the mounting mandrel, an unwinding accelerator for accelerating unwinding of a thread from the bobbin, and a captively controllable displacement apparatus associated with the holder for at least approximately parallel displacement of the mounting mandrel between a tube mounting position below the bobbin delivery slide and an unwinding position below the unwinding accelerator.

11 Claims, 3 Drawing Figures

WINDING STATION OF AN AUTOMATIC WINDING MACHINE

Figure 1:
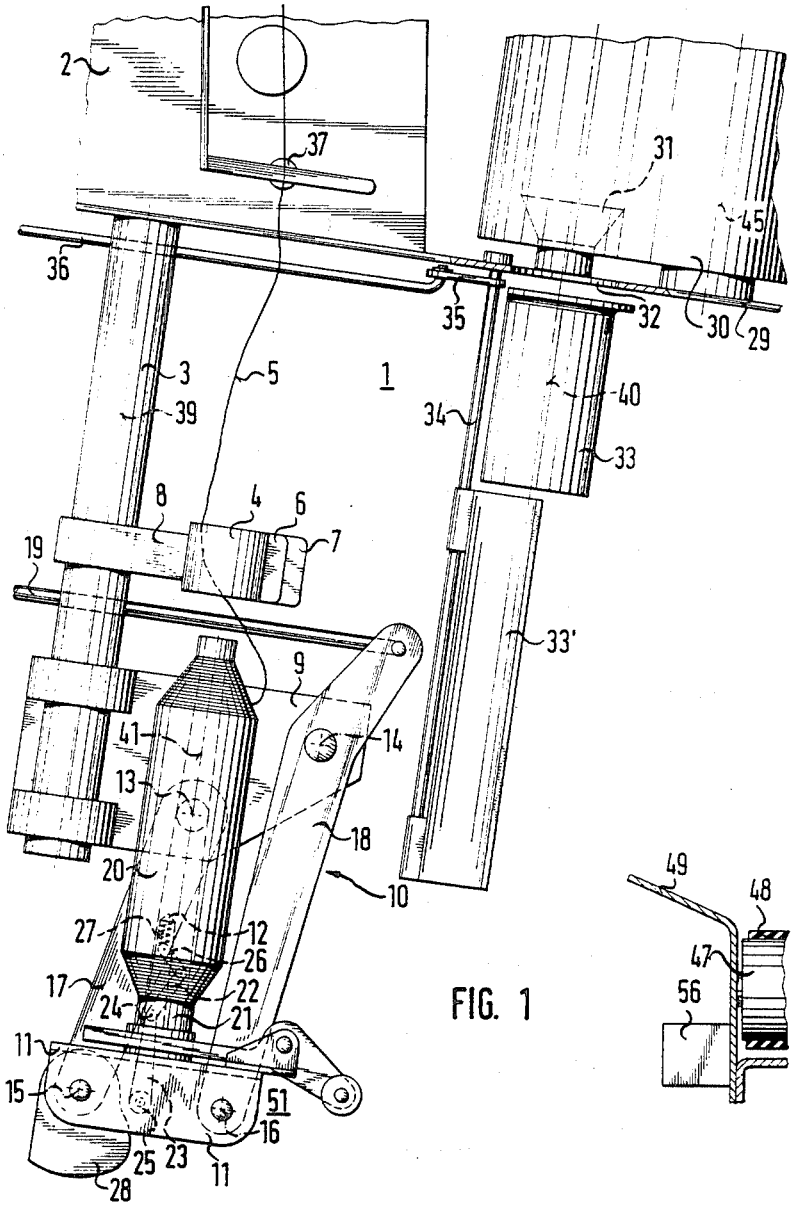

The invention relates to a winding station of an automatic winding machine, having a movable mounting mandrel for a tube or sleeve of a feeding or delivery bobbin or cop, a bobbin delivery slide, and an unwinding accelerator.

In conventional automatic winding machines, a pivotable mounting mandrel is disposed in the extended unwinding direction below the unwinding accelerator. In the unwinding position, the tip of the bobbin tube, in other words the tip of the bobbin, is oriented toward the unwinding accelerator. In order to eject a tube that has become empty and to subsequently mount a new bobbin onto the mounting mandrel, the mounting mandrel is pivoted about its stationary pivot axis, thereby assuming an oblique position relative to the unwinding direction.

A disadvantage of such a device is that the bobbin delivery slide is in a relatively highly inclined position, so that the slide, or a bobbin magazine located at the upper end of the slide, protrudes unnecessarily far into the path of operation. Another disadvantage is that the tube ejection location is located at the level of the stationary pivot axis of the mounting mandrel, which makes it difficult to provide a tube receptacle of considerable size or a tube conveyor belt, unless the entire automatic winding machine is raised so as to remove the tubes from it, which once again makes the machine take up more space and impairs access to and viewing of the automatic winding machine.

The relatively highly inclined position of the bobbin delivery slide makes it more difficult and more time-consuming to load the mounting mandrel with a bobbin. Furthermore, this necessitates a greater length for the bobbin delivery slide.

In its oblique position, the bobbin delivery slide enters the vicinity of the unwinding accelerator, which presents further difficulties. Either the unwinding of the thread is impaired by the bobbin delivery slide, or the bobbin accelerator has to be disposed farther away from the bobbin, which is also disadvantageous.

It is accordingly an object of the invention to provide a winding station of an automatic winding machine, which overcomes the hereinafore-mentioned disadvantages of the heretofore-known devices of this general type, which makes it possible to make the cop delivery slide as steep as possible while the unwinding accelerator is as close as possible to the bobbin, to thereby avoid impairment of unwound thread due to the way in which the bobbin delivery slide is disposed, and to save machine space.

With the foregoing and other objects in view there is provided, in accordance with the invention, a winding station of an automatic winding machine, comprising a holder, a movable mounting mandrel supported by the holder for receiving a tube of a feeding bobbin, a bobbin delivery slide or chute for feeding a bobbin to the mounting mandrel, an unwinding accelerator for accelerating unwinding of a thread from the bobbin, and a captively controllable displacement apparatus associated with the holder for at least approximately parallel displacement of the mounting mandrel between a tube mounting position below the bobbin delivery slide and an unwinding position below the unwinding accelerator.

According to the invention, it is possible to position the bobbin delivery slide parallel, or approximately parallel, to the direction of unwinding of the thread, so that only a small bobbin delivery slide is required to assure the required mounting force. At the same time, the bobbin delivery slide remains outside of the thread unwinding vicinity, and the unwinding accelerator can be disposed as close as desired to the tip of the bobbin tube.

In accordance with another feature of the invention, the controllable displacement apparatus moves the holder for moving the mounting mandrel beyond the mounting position into a tube discarding position in which the mounting mandrel assumes an inclined position relative to the mounting position. The inclination of the mounting mandrel in the tube discarding position facilitates discarding of the tubes.

In accordance with a further feature of the invention, the controllable displacement apparatus is a four-bar linkage mechanism connected to the holder or the controllable displacement apparatus and the holder are part of a four-bar linkage mechanism.

In accordance with an added feature of the invention, there is provided a machine frame, the four-bar linkage mechanism including pivotal linkage members having given lengths and pivot points spaced apart by given distances connecting the linkage members to given locations on the machine frame and on the holder, the given lengths, distances and locations placing the mounting position of the mounting mandrel at a higher level than the unwinding position and placing the tube discarding position at a higher level than the mounting position, the mounting mandrel assuming an inclined position relative to the mounting position, in the tube discarding position. This is done in order to reduce the machine height and thus to reduce the amount of space required for the machine, while at the same time improving accessibility to and monitoring of the automatic winding machine.

If the mounting mandrel holder is rather close to the bottom of the machine in the unwinding position, then the mounting position is already farther from the bottom of the machine and the tube discarding position is still farther away. Thus without additionally raising the machine, it is possible to provide a suitably large tube receptacle at the tube discarding location, or to provide a tube conveyor belt at a favorable location which is not too close to the floor.

In accordance with an additional feature of the invention, the holder includes an automatic tube ejector disposed at a tube ejection location having an obstruction, and the tube ejector includes a two-armed lever pivotally supported on the holder, the lever having a first forked lever arm disposed on right and left sides of the mounting mandrel below a tube on the mandrel in a rest position, and a second lever arm being activated by striking the obstruction.

Accordingly, the four-bar linkage mechanism requires only one power source or adjusting apparatus, which then also exerts the force for ejecting the tubes. Thus it is possible to postpone the ejection of the tubes until the precisely correct instant.

In accordance with yet another feature of the invention, the mounting mandrel includes an automatic tube clamp, a control lever connected to the tube clamp for switching off the tube clamp, and a control cog rigidly connected to one of the linkage members of the four-bar linkage mechanism for controlling the control lever. For instance, in the mounting position and in the tube discarding position, there is contact between the control cog and the control lever, so as to disable the tube clamp. On the other hand, in the unwinding position, there is no contact between the control cog and the control lever, so that the tube clamp is fully operative, such as due to spring force, and firmly clamps the tube to the mounting mandrel in the unwinding position. Other features which are considered as characteristic for the invention are set forth in the appended claims.

Although the invention is illustrated and described herein as embodied in a winding station of an automatic winding machine, it is nevertheless not intended to be limited to the details shown, since various modifications and structural changes may be made therein without departing from the spirit of the invention and within the scope and range of equivalents of the claims. The construction and method of operation of the invention, however, together with additional objects and advantages thereof will be best understood from the following description of specific embodiments when read in connection with the accompanying drawings.

Figure 2:
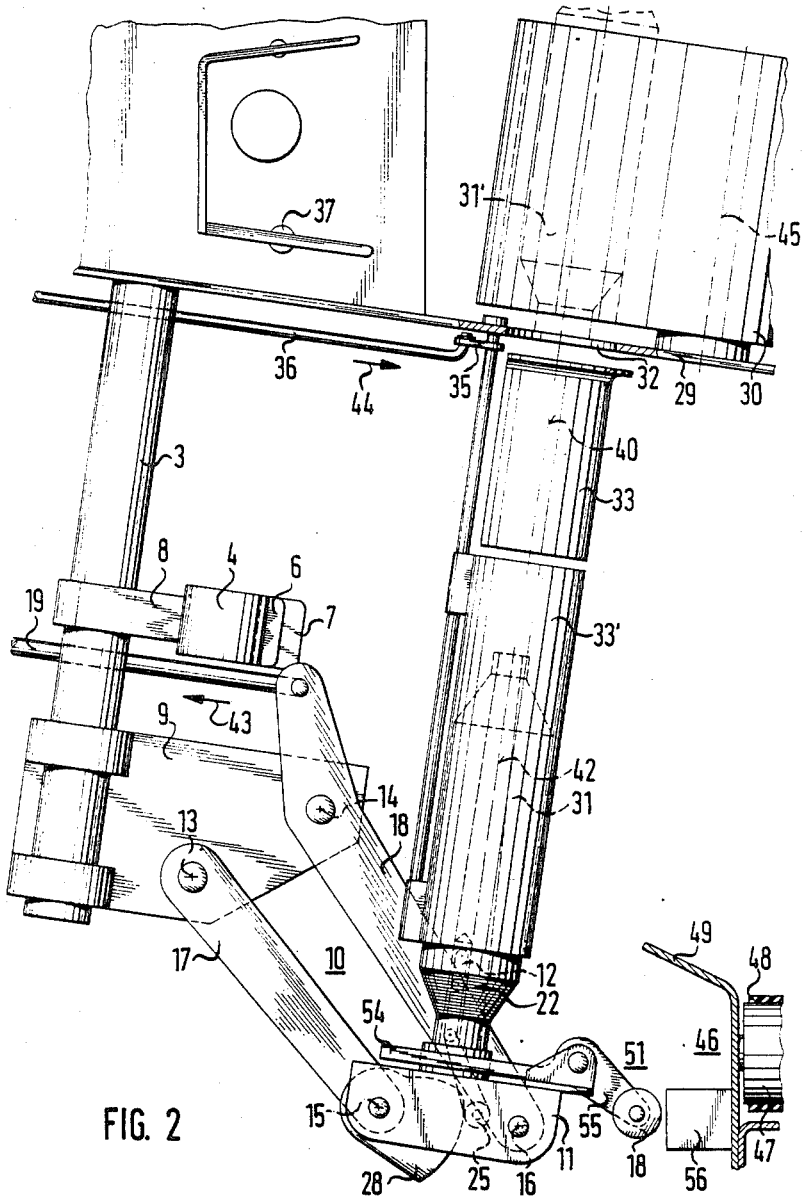
Figure 3:
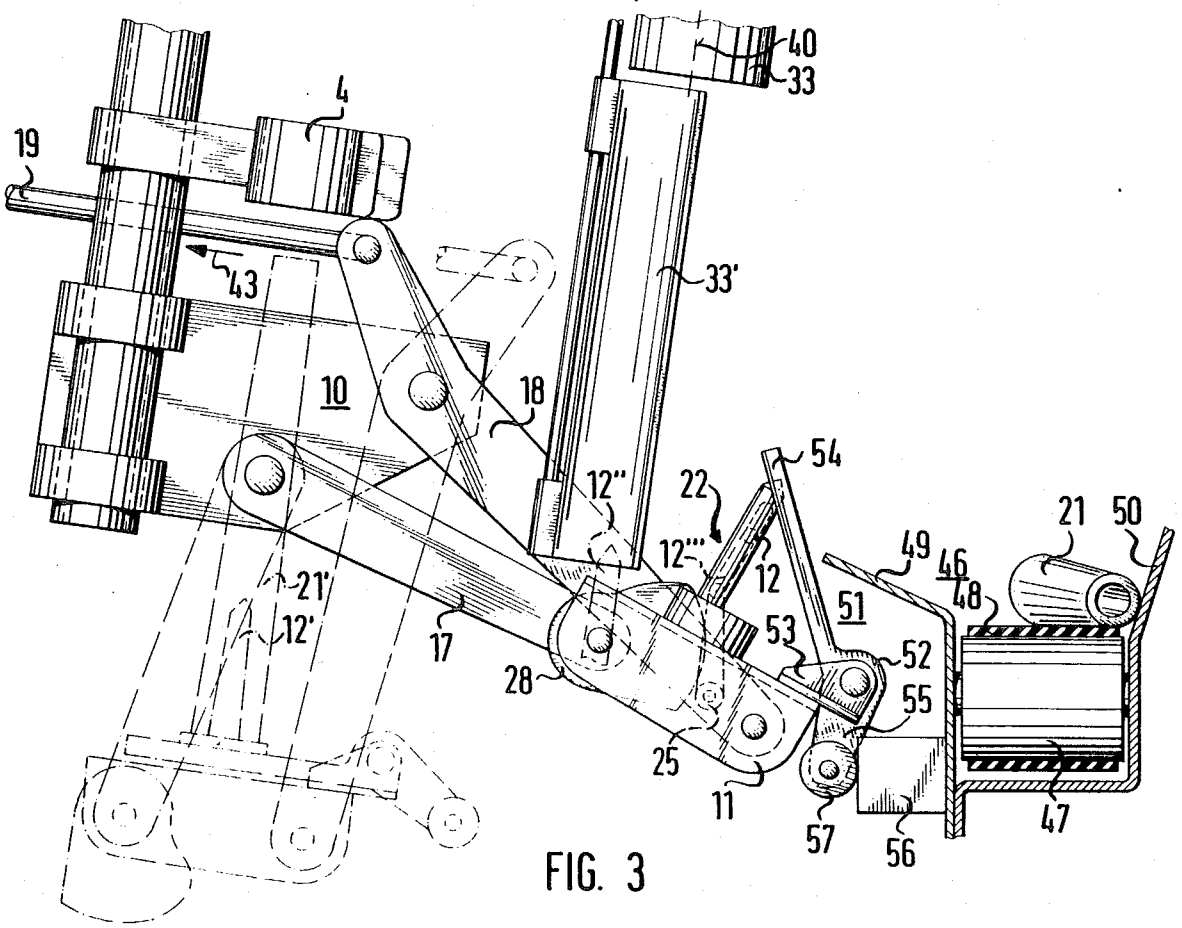

FIG. 1 is a fragmentary, diagrammatic, side-elevational view of a winding station at which the apparatus according to the invention is disposed;

FIG. 2 is a view similar to FIG. 1, showing the apparatus in the mounting position; and FIG. 3 is another similar view showing a portion of FIGS. 1 and 2 with the apparatus in the tube discarding position. Referring now to the figures of the drawings in detail and first, particularly to FIG. 1 thereof, it is seen that a machine frame 2 of a winding station generally indicated by reference numeral 1, has a holder rod 3 that is inclined from the vertical and carries an unwinding or take-off accelerator 4. The unwinding accelerator 4 has a body made of sheet metal, which has a through opening for a thread 5 that is to be drawn or taken off. Two ends 6, 7 of the sheet-metal body are spread outwardly apart toward the front, thus producing a threading slit for the thread 5. The unwinding accelerator functions as a sort of balloon breaker, which substantially increases the thread unwinding speed. The unwinding accelerator 4 is secured to the holder rod 3 with a clip 8.

A rail 9 is secured to the holder rod 3 below the unwinding accelerator 4. The rail 9 supports a four-bar linkage mechanism generally identified by reference numeral 10, which in turn supports a holder 11. A mounting mandrel or arbor 12 is secured perpendicular to the surface of the holder 11.

The four-bar linkage mechanism 10 has two pivot or hinge points 13, 14 located on the rail 9 and two pivot or hinge points 15, 16 located on the holder 11. The pivot points 13 and 14 are located in a plane that is inclined with respect to the holder rod 3, while the pivot points 15 and 16 are located in a plane that is parallel to the surface of the holder 11. The four-bar linkage mechanism 10 also has two movable linkage members 17 and 18, which are dimensioned differently from one another. The linkage member 17 is located at the rear and connects the pivot points 13 and 15 with one another. The linkage member 18 is located at the front and connects the pivot points 14 and 16 with one another. The linkage member 18 is longer than the linkage member 17 and terminates at the top in an extension in which a draw bar or pull rod 19 is pivotably suspended.

The linkage member 18 and hence the four-bar linkage mechanism 10, can be pivoted by means of the draw bar 19. The pivoting of the four-bar linkage member 10, that is, the actuation of the draw bar 19, is carried out, for example, by a knotting or splicing carriage that is movable lengthwise along the automatic winding machine, or by the winding station 1 directly.

FIG. 1 shows that the mounting mandrel 12 supports the tube or sleeve 21 of a feeding or delivery spool or bobbin 20, from which the thread 5 is pulled off. In order to retain the tube 21, the mounting mandrel 12 has an automatic tube clamp 22 that can be switched on and off. The essential parts of the tube clamp 22 are disposed in a longitudinal slit in the mounting mandrel 12 in such a way that when the tube clamp is inactive, they do not hinder the mounting and subsequent removal of the tubes, but when the tube clamp is active, they press the tube against the mounting mandrel 12 and thereby clamp it firmly. A control lever 23 of the tube clamp 22 is pivotable about a pivot point 24. The control lever 23 is provided with two arms. The lower end of the lever 23 supports a roller 25, while its upper end is pivotably connected to a toggle lever 26. The toggle lever 26 is prestressed by a compression spring 27 in such a way that it emerges from the lateral slit in the mounting mandrel 12 together with the upper end of the control lever 23, if the roller 25 is not positively displaced to the side by a control cog 28. The control cog 28 is connected to the linkage member 17 of the four-bar linkage mechanism 10.

FIG. 1 shows how far the toggle lever 26 is deflected in order to retain the tube 21 of the bobbin 20.

The machine frame 2 also has a rail 29, which has a round magazine 30 for feeding or delivery spools or bobbins 31. Disposed below an opening 32 in the rail 29, is a bobbin delivery slide or chute 33, the lower portion 33' of which is pivotable. To this end, the portion 33' of the bobbin delivery slide 33 has a pivot shaft 34 which is supported on the rail 29 and is connected to a control lever 35. A draw bar or pull rod 36 is pivotably connected to the control lever 35. The draw bar 36 can also be actuated by the above-mentioned knotting or splicing carriage or by the winding station 1 itself for changing bobbins.

The thread 5 passes through thread guide means 37 and a non-illustrated thread cleaner, so as to be wound up into a cheese or cross-wound bobbin, in a non-illustrated manner.

The longitudinal axis 39 of the holder rod 3 is parallel to the thread unwinding or withdrawal direction and parallel to the longitudinal axis 40 of the bobbin delivery slide 33.

The four-bar linkage mechanism 10 serves as a captively controllable displacement apparatus for parallel displacement of the mounting mandrel 12 from the unwinding position shown in FIG. 1 and identified with reference numeral 12' in FIG. 3, to a mounting position shown in FIG. 2 and identified with reference numeral 12'' in FIG. 3. The longitudinal axis 41 of the bobbin 20 is oriented in the unwinding direction and is located parallel to the longitudinal axis 39 of the holder rod 3, in the unwinding position shown in FIG. 1. However, as shown in FIG. 2, the longitudinal axis 42 of the bobbin 31 is aligned with the longitudinal axis 40 of the cop delivery slide 33. In the mounting position, the bobbin 31 is already extended onto the mounting mandrel 12 but it previously assumed the position 31' in the round magazine 30.

By moving the draw bar 19 in the direction of the arrow 43 shown in FIG. 3, the mounting mandrel 12 is moved into the mounting position shown in FIG. 2. In order to mount a bobbin onto the mandrel, the draw bar 36 is moved in the direction of the arrow 44 in FIG. 2, so as to pivot the portion 33', such that this portion 33' forms the bobbin delivery slide together with the other portion of the bobbin delivery slide 33.

The transfer of a bobbin from the round magazine 30 is effected by rotating the round magazine 30 about its longitudinal axis 45, until a bobbin is located above the opening 32 and then drops into the bobbin delivery slide 33 and from there onto the mounting mandrel 12, as shown in FIG. 2, due to its own weight.

The movement of the round magazine may also be initiated or carried out by the above-mentioned knotting or splicing carriage or directly by the winding station 1, depending on how it is constructed or set.

In FIG. 3, the tube is shown in phantom lines. After the thread has been unwound from the tube, the tube initially assumes the position given reference numeral 21'.

Before a new bobbin is received, the old tube must first be removed. This is done by providing that the holder 11 and thus the mounting mandrel 12 as well are movable beyond the mounting position shown in FIG. 2, into a tube discarding position, shown in FIG. 3. In the tube discarding position 12''', the mounting mandrel 12 assumes a position that is inclined forward as compared with its mounting position.

The tube discarding location is generally identified with reference numeral 46. A tube conveyor belt 48 which is deflectable over belt rollers 47 and is bordered on the left and right by side walls 49, 50, is located at the tube discarding location 46.

In order to transfer an empty tube 21 to the tube conveyor belt 48, the holder 11 has an automatic tube ejector 51. The tube ejector has a two-armed lever 52 that is pivotably supported on the holder 11 and is pivotably supported on a bracket 53. A first lever arm 54, which in this case is the longer one, is forked and is located to the left and right of the mounting mandrel 12, below the tube 21, in its rest position which is shown in FIGS. 1 and 2. A second lever arm 55 is actuatable and controllable by striking an obstruction 56 provided at the tube discarding location 46. To this end, the shorter lever arm 55 supports a roller 57. The obstruction 56 is in the form of a block attached to the side wall 49.

FIG. 3 shows that the tube 21 has already been stripped from the mounting mandrel 12 and transferred to the tube conveyor belt 48. The draw bar 19 is then moved counter to the direction of the arrow 43, until the mounting mandrel 12 and holder 11 have attained the mounting position shown in FIG. 2. The two-armed lever 52 automatically folds back into its initial position during this movement.

FIGS. 2 and 3 show how the control cog 28 acts upon the roller 25, so as to cause the toggle lever of the tube clamp 22 to become extended. The mounting mandrel 12 then does not present any hindrance to the mounting of a new bobbin thereon.

The distances by which the linkage members 13-16 are spaced apart from one another, the location of the pivot points on the machine frame 2, on the rail 9 and on the holder 11 and the lengths of the pivotable linkage members 17, 18, are selected in such a way that the mounting position 12'' of the mounting mandrel 12 in FIG. 3, is higher than the unwinding position 12'. The tube discarding position 12''' is even higher than the mounting position 12'' and moreover, as already mentioned, the mounting mandrel 12 assumes an inclined position in the tube discarding position 12''' relative to its mounting position 12''.

Once a new bobbin has been received, first the draw bar 36 is moved counter to the direction of the arrow 44, in order to pivot the portion 33' to the side, and then the draw bar 19 is moved farther, counter to the direction of the arrow 43, in order to ensure that the mounting mandrel 12 resumes the unwinding position shown in FIG. 1. Susequently, a new winding operation can begin, which is initiated in the typical and conventional manner for automatic winding machines.

We claim:

1. Winding station of an automatic winding machine, comprising a holder, a movable mounting mandrel supported by said holder for receiving a tube of a feeding bobbin, a bobbin delivery slide for feeding a bobbin to said mounting mandrel, an unwinding accelerator for accelerating unwinding of a thread from the bobbin, and a captively controllable displacement apparatus associated with said holder for at least approximately parallel displacement of said mounting mandrel between a tube mounting position below said bobbin delivery slide and an unwinding position below said unwinding accelerator.

2. Winding station according to claim 1, wherein said controllable displacement apparatus moves said holder for moving said mounting mandrel beyond said mounting position into a tube discarding position in which said mounting mandrel assumes an inclined position relative to said mounting position.

3. Winding station according to claim 1, wherein said controllable displacement apparatus is a four-bar linkage mechanism connected to said holder.

4. Winding station according to claim 1, wherein said controllable displacement apparatus and said holder are part of a four-bar linkage mechanism.

5. Winding station according to claim 2, wherein said controllable displacement apparatus is a four-bar linkage mechanism connected to said holder.

6. Winding station according to claim 2, wherein said controllable displacement apparatus and said holder are part of a four-bar linkage mechanism.

7. Winding station according to claim 5, including a machine frame, said four-bar linkage mechanism including pivotal linkage members having given lengths and pivot points spaced apart by given distances connecting said linkage members to given locations on said machine frame and on said holder, said given lengths, distances and locations placing said mounting position of said mounting mandrel at a higher level than said unwinding position and placing said tube discarding position at a higher level than said mounting position, said mounting mandrel assuming an inclined position relative to said mounting position, in said tube discarding position.

8. Winding station according to claim 1, wherein said holder includes an automatic tube ejector.

9. Winding station according to claim 8, wherein said tube ejector is disposed at a tube ejection location having an obstruction, and said tube ejector includes a two-armed lever pivotally supported on said holder, said lever having a first forked lever arm disposed on two sides of said mounting mandrel below a tube on said mandrel in a rest position, and a second lever arm being activated by striking said obstruction.

10. Winding station according to claim 7, wherein said mounting mandrel includes an automatic tube clamp, a control lever connected to said tube clamp for switching off said tube clamp, and a control cog rigidly connected to one of said linkage members of said four-bar linkage mechanism for controlling said control lever.

11. Winding station according to claim 5, wherein said four-bar linkage mechanism includes pivotal linkage members, and said mounting mandrel includes an automatic tube clamp, a control lever connected to said tube clamp for switching off said tube clamp, and a control cog rigidly connected to one of said linkage members of said four-bar linkage mechanism for controlling said control lever.

* * * * *